US007207427B2

(12) United States Patent
Kuhnert et al.

(10) Patent No.: US 7,207,427 B2
(45) Date of Patent: Apr. 24, 2007

(54) BASE FOR AN ESCALATOR OR MOVING WALKWAY

(75) Inventors: Joachim Kuhnert, Gelsenkirchen (DE); Thomas Zellin, Hattingen (DE); Huu-Bao Nhan, Duisburg (DE)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/472,531

(22) Filed: Jun. 22, 2006

(65) Prior Publication Data

US 2007/0007107 A1 Jan. 11, 2007

Related U.S. Application Data

(63) Continuation of application No. PCT/DE2004/002655, filed on Dec. 3, 2004.

(30) Foreign Application Priority Data

Dec. 22, 2003 (DE) ..... 103 60 377

(51) Int. Cl.
*B66B 23/24* (2006.01)

(52) U.S. Cl. ..... 198/335

(58) Field of Classification Search ..... 198/321, 198/326, 335

See application file for complete search history.

(56) References Cited

U.S. PATENT DOCUMENTS 4,646,907 A 3/1987 Streibig et al.
4,819,781 A * 4/1989 Saito et al. ..... 198/335
5,156,251 A * 10/1992 Johnson ..... 198/335
5,180,047 A * 1/1993 Barrett et al. ..... 198/335
5,186,302 A * 2/1993 Johnson et al. ..... 198/335
5,215,177 A * 6/1993 Johnson et al. ..... 198/335
5,277,505 A 1/1994 Nurnberg et al.
5,458,220 A * 10/1995 Nguyen et al. ..... 198/335
5,601,179 A * 2/1997 Wente et al. ..... 198/335
6,533,098 B1 * 3/2003 Winkler ..... 198/321

FOREIGN PATENT DOCUMENTS

EP 1 142 820 A1 10/2001

* cited by examiner

*Primary Examiner*—James R. Bidwell
(74) *Attorney, Agent, or Firm*—Venable LLP; Robert Kinberg

(57) ABSTRACT

An arrangement for a base region of an escalator or moving walkway includes an external covering element for being attached in the base region of the escalator or moving walkway. A substructure includes a profile, a support element extending from the profile and a magnet disposed on the support element. The external covering element is detachably mounted to the substructure in a region of the profile and in a region of the magnet.

14 Claims, 2 Drawing Sheets

BASE FOR AN ESCALATOR OR MOVING WALKWAY

CROSS-REFERENCE TO RELATED APPLICATIONS

This application is a continuation of International Patent Application No. PCT/DE2004/002655, filed Dec. 3, 2004, designating the United States and claiming priority from German Application No. 10360377.8, filed Dec. 22, 2003. The subject matter of the foregoing applications and each and every U.S. and foreign patent and patent application mentioned below is incorporated herein by interest.

BACKGROUND OF THE INVENTION

The invention relates to a device for attaching a base end element, in particular an external covering element in a base zone of an escalator or moving walkway.

German patent document DE-A 199 37 618 discloses a balustrade for a passenger transport installation which comprises a substructure that receives the lower part of the balustrade as well as a covering that is provided on the side of the base and is eventually composed of single segments. The substructure comprises profiles in the region of which the covering or the segments forming the covering is or are provided in a detachable manner by slipping the covering or segments forming the covering on the profiles. The substructure disclosed in this German patent document is relatively complex. In case of a frequent exchange of the coverings it can happen that a new alignment of the coverings becomes necessary due to changes of the tolerances, whereby the time required for maintenance and repair will be increased.

A similar base construction is described in U.S. Pat. No. 5,542,522, wherein a plurality of profiles forming the substructure is used and the end elements can be displaced with respect to the substructure on the side of the base by means of a clip connection.

SUMMARY OF THE INVENTION

It is an object of the invention to provide an attachment of base end elements, in particular external covering elements, without any screws and any adhesive in the base region of an escalator or moving walkway, which requires a short time for the assembly/disassembly and wherein in the field of maintenance, a replacement of damaged base end elements, in particular external covering elements, can be quickly realised without any problems and with low costs.

The above and other objects are accomplished by the provision of an exemplary embodiment of the invention wherein there is provided an arrangement for a base region of an escalator or moving walkway, comprising: an external covering element for being attached in the base region of the escalator or moving walkway; and a substructure including a profile, a support element extending from the profile and a magnet disposed on the support element, wherein the external covering element is detachably mounted to the substructure in a region of the profile and in a region of the magnet.

An advantage with respect to known constructions of this type mentioned above is the simpler structure of the entire substructure. The base end elements, in particular the external covering elements, can be attached and retained by magnetic force. This leads to the advantage of extremely reduced time consumption for assembly and disassembly.

Further, in the case of a recurrent exchange of base end elements, in particular external covering elements, the receiving elements will not be damaged, so that equivalent assembly situations can be achieved. Furthermore, competitive advantages can be obtained in those countries in which a screwing or gluing of base end elements, in particular external covering elements in the base region of escalators or moving walkways, is not desired or not allowed. The attachment of the base end elements, in particular the external covering elements, essentially only comprises the quasi-horizontal support elements, the magnets and the sheet metal parts to be edged, which can be eventually provided.

The sheet metal parts desirably have a hook-shaped edge which serves as an additional safety element. Seen in the direction of assembly of the base end element, in particular the external covering element, the hook-shaped edge engages on the side of the magnet facing the profile, such that unauthorized persons can only remove the respective base end element, in particular the external covering element, from its position with great difficulty.

The device according to the invention additionally enables the provision magnets both on the side of the profiles and in the free end region of the support elements.

It is furthermore possible to insert the external covering elements on the side of the base into an end receiving element and to provide magnets only in the free end region of the support elements. A person skilled in the art will adapt the respectively desired design to a particular application.

According to another aspect of the invention, the magnets can be attached with glue or alternatively by screws to the support element in the regions of the support element mentioned above.

The support element may have one or more bracket-like shoulders for receiving connection elements, for example, hammer-head bolts, that engage in a longitudinal grove provided in the profile, so that the position of the support element may be adjusted in relation to profile. The bracket-like shoulder may include a punched out segment that is directed in the direction of the receiving groove of the hammer-head bolts. Such punched out segment engages in the longitudinal groove and thus excludes a vertical reset or a vertical alignment of the support element. The support element is thus attached exclusively by the connection elements to the vertical profile, which may be made, for example, of aluminium. After the pre-assembly of the support element and the magnet and the sheet metal part that is provided if necessary, the respective external covering element, may be inserted with a pre-determinable angle with one end thereof into the receiving element of the profile and will be afterwards pressed on the magnet at the other end thereof.

BRIEF DESCRIPTION OF THE DRAWINGS

The subject of invention is represented by an exemplary embodiment and is described as follows in conjunction with the drawings, wherein.

DETAILED DESCRIPTION OF THE INVENTION

Figure 1:
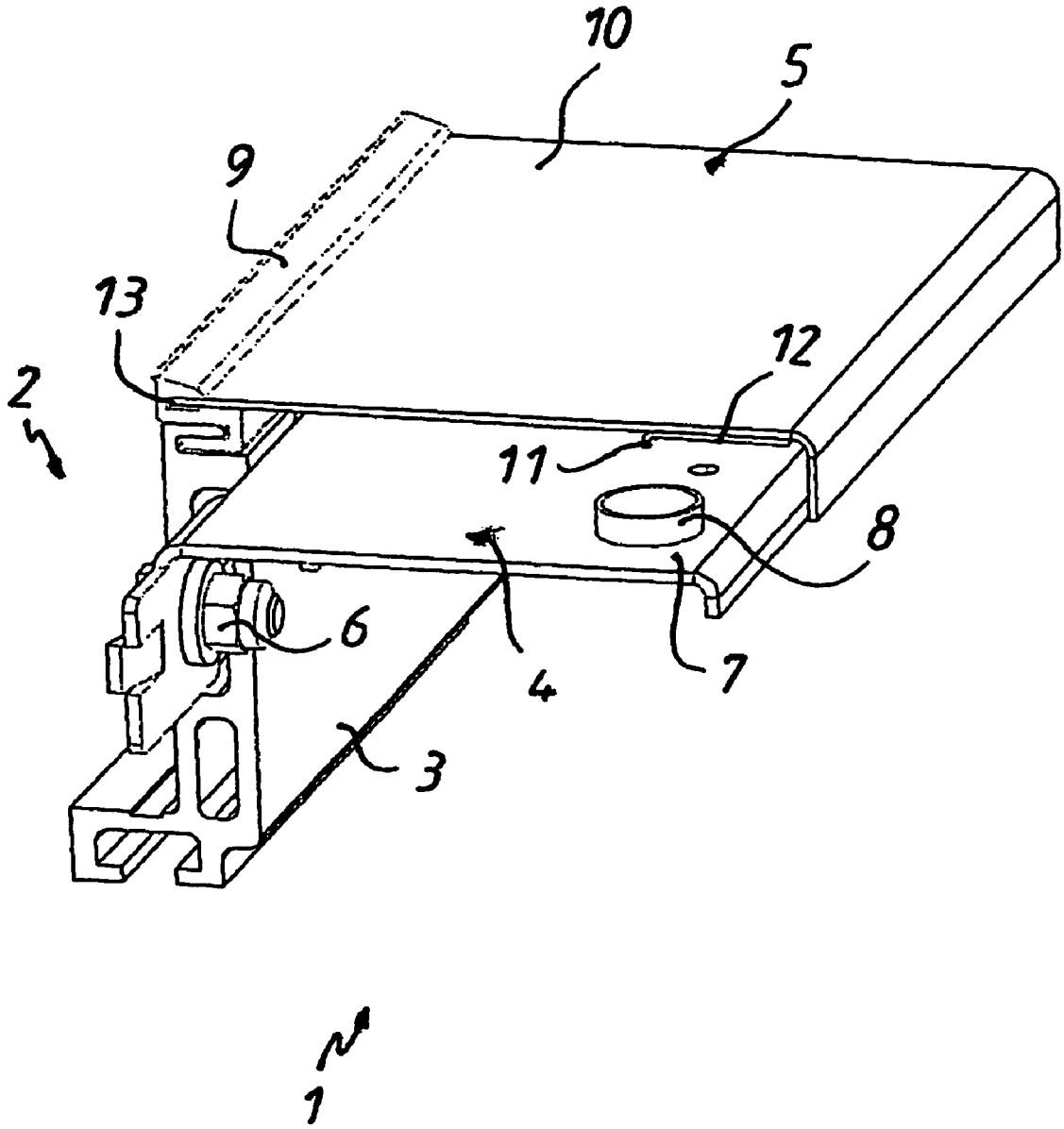
FIG. 1 is a perspective view from the top right side of the device shown in FIG. 2.

Referring to FIG. 1, there is shown an exemplary embodiment of a base region 1 for an escalator or a moving walkway, neither of which is shown. The base region 1 comprises a substructure 2 composed of vertical profiles 3 made of aluminium. Profiles 3 are in active relation with support elements 4 that are approximately orthogonal to vertical profiles 3. A base end element, which in this example is an external covering element 5, is fixed without any screws or any adhesive in the base region 1. The support element 4 is connected to the profile 3 via detachable connection elements 6. Magnets 8, which are preferably permanent magnets, are provided in a free end region 7 of the support element 4. In the region on the side of the external covering of profile 3, a receiving element 9 is provided that serves for receiving the free end region 10 of the external covering element 5 in this example. Alternatively, it is also possible to provide magnets 8 in the region on the profile side of the respective support element 4.

Like the external covering element 5, the support element 4 is provided as an angle section. Furthermore, the external covering element 5 has a sheet metal part 12 provided with a hook 11, which is in this example, is provided on the side of the magnet. The receiving element 9 includes a slot 13 on the side of the covering, into which slot the free end 10 of the external covering element 5 is introduced. FIG. 1 shows the assembly, in which the free end region 10 of the external covering element 5 is introduced into the slot 13 of the receiving element 9. Herein, the hook 11 is still above the magnet 8.

Figure 2:
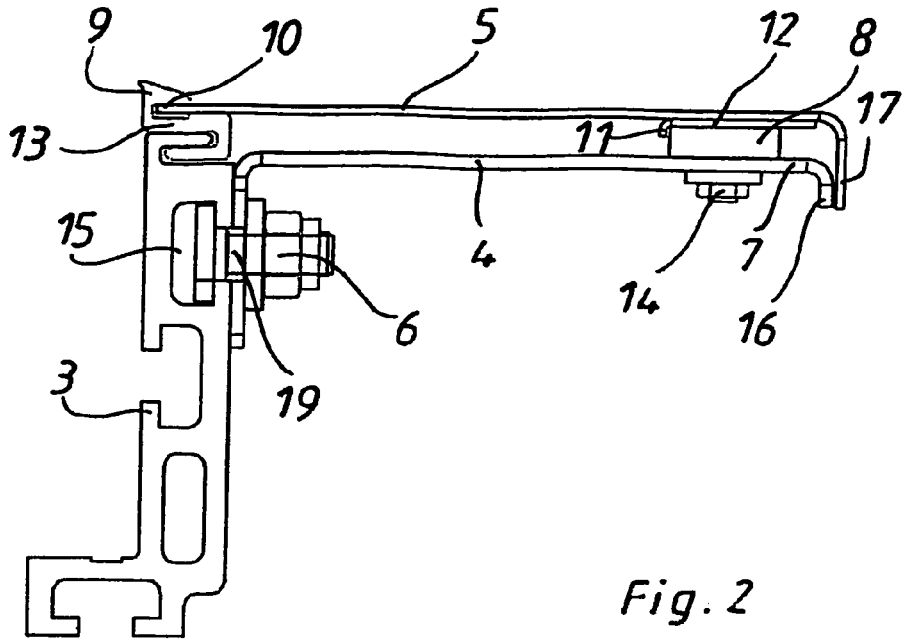
FIG. 2 is an end elevation of the device according to the invention.
Figure 3:
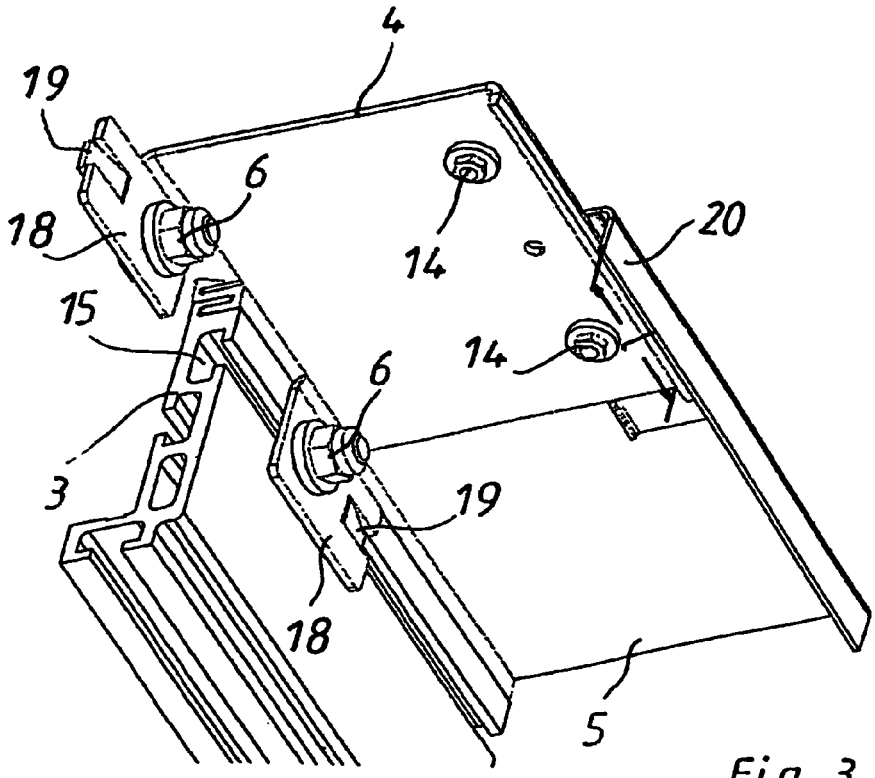
FIG. 3 is a perspective view from the bottom right of the device shown in FIG. 2.

FIGS. 2 and 3 show different views of the external covering element in an already assembled state 5. Shown are the profile 3, the receiving element 9 formed as a trimming profile, the support element 4, the sheet metal part 12 including hook 11, the magnet 8 as well as a screw 14 connecting the magnet 8 to the free end 7 of the support element 4. The profile 3 includes at least one groove 15 extending in a longitudinal direction thereof, which groove serves for receiving a connection element 6 that is here a hammer-head bolt. The free end 10 of the external covering element 5 is inserted into the slot 13 of the receiving element 9, wherein the hook 11 of the sheet metal part 12 is placed in front of the magnet 8 on the profile side. A removal of the external covering element 5 due to vandalism can thus only be realized with strong forces by a person not skilled in the art. In the assembled state, the 90° offset part 16 of the support element 4 is essentially adjacent in a flush manner to the 90° offset part 17 of the external covering element 5. The support elements 4 have bracket-like shoulders 18, on which the connection elements 6 are guided and displaced in the region of the respective groove 15. Furthermore, punched out segments 19 that are bent in the direction of groove 15 are provided on each bracket-like shoulder 18. Since the segments 19 at least partially project into the groove 15, a vertical reset/vertical alignment of the support element 4 will be excluded. The support element 4 is exclusively fixed via the connection elements 6. The sheet metal part 12 is connected to the external covering element 5 preferably by gluing or by spot welding. Herein, the length of the sheet metal part 12 can be variable. The shorter it is, the more precisely it has to be adapted to the position of the magnet 8, seen in the longitudinal direction of the external covering element 5. The sheet metal part 12 is mounted on the external covering element 5 such that the hook 11 is directed in parallel to, but against the direction of assembly of the external covering element 5 and after the assembly of the external covering element 5 hook 11 engages behind the magnets 8 on the profile side. The sheet metal part 12 serves for forming the contact surface with the magnets 8 on the one hand and for preventing, together with the hook 11, a detachment of the external covering element 5 (direction of motion against the receiving element 9). Dependent on the length of the respective external covering element 5, the support elements 4 are advantageously positioned in the end regions 20 of the profile 3, wherein they overlap a predeterminable length I of the respective external covering element 5. If the external covering elements are especially long, additional support elements 4 may be provided within the longitudinal extension of the respective external covering elements 5, in order to act against an undesired deflection of the respective external covering element 5.

The invention has been described in detail with respect to referred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. An arrangement for a base region of an escalator or moving walkway, comprising:

an external covering element for being attached in the base region of the escalator or moving walkway; and a substructure including a profile, a support element extending from the profile and a magnet disposed on the support element, wherein the external covering element is detachably mounted to the substructure in a region of the profile and in a region of the magnet.

2. The device according to claim 1, wherein the profile is vertical and the support element is essentially orthogonal thereto and is detachably connected to the profile.

3. The device according to claim 2, wherein the support element is detachably connected to the profile by screw connections.

4. The device according to claim 1, wherein the support element has an end adjacent the profile that includes a bracket, and further comprising a connection element to connect the bracket to the profile.

5. The device according to claim 4, wherein the connection element is a hammer-head screw.

6. The device according to claim 1, and further including a receiving element disposed on an external end of the profile to receive and support a free end of the external covering element.

7. The device according to claim 1, wherein the magnet is a permanent magnet disposed in an end region of the support element opposite the profile.

8. The device according to claim 1, wherein the magnet is disk-shaped and is detachably connected to the support element.

9. The device according to claim 1, wherein the magnet is connected to the support element by glue.

10. The device according to claim 1, and further including a sheet metal part disposed on a side of the external covering element facing the magnet, wherein the sheet metal part includes an edge in a region of the magnet.

11. The device according to claim 10, wherein the sheet metal part is connected to the external covering element by glue or a spot weld.

12. The device according to claim 10, wherein the edge of the sheet metal part is hook-shaped and the hook-shaped edge of the sheet metal part is located on a side of the magnet between the magnet and the profile element.

13. The device according to claim 10, wherein the support element is positioned in an end zone of the external covering element so as to overlap the external covering element by a pre-determined length.

14. The device according to claim 4, wherein the profile includes a groove that receives the connection element that connects the bracket to the profile, and the bracket includes a punched out segment which at least partially projects into the groove of the profile.

* * * * *